US006860842B1

(12) United States Patent
Hinds

(10) Patent No.: US 6,860,842 B1
(45) Date of Patent: Mar. 1, 2005

(54) INTERMEDIATE SECTION FOR EXERCISE BAR

(76) Inventor: Robert Sylvester Hinds, 1803 Regent St., Madison, WI (US) 53705

( * ) Notice: Subject to any disclaimer, the term of this patent is extended or adjusted under 35 U.S.C. 154(b) by 17 days.

(21) Appl. No.: 10/696,915

(22) Filed: Oct. 29, 2003

Related U.S. Application Data

(63) Continuation-in-part of application No. 10/602,928, filed on Jun. 23, 2003.

(51) Int. Cl.[7] ..... A63B 22/00
(52) U.S. Cl. ..... 482/139; 482/148
(58) Field of Search ..... 482/92, 139, 148

(56) References Cited

U.S. PATENT DOCUMENTS

| | | | | |
|---|---|---|---|---|
| 1,456,304 A | | 5/1923 | Fritschka | |
| 2,937,653 A | | 5/1960 | Danciart et al. | |
| 4,316,610 A | | 2/1982 | Hinds | |
| 5,131,650 A | * | 7/1992 | Hall | 482/126 |
| 5,788,608 A | * | 8/1998 | Wilkinson | 482/51 |
| 6,247,483 B1 | * | 6/2001 | Tung | 135/38 |

* cited by examiner

*Primary Examiner*—Glenn E. Richman
(74) *Attorney, Agent, or Firm*—Loyd W. Bonneville

(57) ABSTRACT

An intermediate section is inserted into the mid-portion of an exercise bar's body to increase its effectual length. The section is locked in place at each end thereof by the protrusion of a separation release button in one of the connecting members through a button opening in the member it is joined to. The button is retained in place either by a grasshopper leg spring supported upon a spring seat or a plastic memory resilient integral finger as snap-fit connection means.

5 Claims, 14 Drawing Sheets

PRIOR ART 310
371
311
340
312
300
PRIOR ART 310
371
311
340
312
300
PRIOR ART

PRIOR ART

INTERMEDIATE SECTION FOR EXERCISE BAR

This instrument, filed under 37 CFR 1.53(b) and 1.78, invoking the provisions of 35 U.S.C. 120, is a Continuation-in-Part of presently copending application Ser. No. 10/602,928 entitled "Exercise Bar and Cord Connector", filed Jun. 23, 2003.

BACKGROUND OF THE INVENTION

1. Field of the Invention

Exercise equipment

2. Description of the Prior Art

Occasionally a descriptive term in this application may be shortened so as to recite only a part rather than the entirety thereof as a matter of convenience and to avoid needless redundancy. In instances in which that is done, applicant intends that the same meaning be afforded each manner of expression. Thus, the term bar separation release button 31 might be used in one instance but in another, if meaning is otherwise clear from context, expression might be shortened to release button 31 or merely button 31. Any of those forms is intended to convey the same meaning.

The term attach or fasten or any of their forms when so used means that the juncture is of a more or less permanent nature, such as might be accomplished by bolts, welds or adhesives. Thus it is stated herein that one side of the prior art resilient integral finger 348 partially cut out of the bar's body 310 from which it 348 was formed remained attached to it 310. A connection in which one object is easily removed from another is described by the word emplace, as where it is stated herein that in preparation for the snap-fit 32 connection, the intervening section's insertion end 12 is slid into or emplaced within one portion of the exercise bar's body 310. A connection in which two objects, though not attached, could be separated only with at least some degree of difficulty is referred to herein as one of rigid emplacement. The snap-fit means of connection 32, once completed between the intervening section which is the subject hereof and the exercise bar's body 310 is stated herein to be such a connection. Employment merely of the words connector join or forms derived from their roots is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that the bar separation seam 340 comprised the dividing place between the two parts of the bar's elongated extension or body 310, meaning that the place indicated actually was that seam 340. The term comprise may also be characterized by what might be considered one-way equivalency, as when it is stated herein that the grasshopper leg spring 347 in conjunction with a spring seat 344 within the bar's body 310 sometimes comprised the snap-fit means 342 provided in certain of the prior art exercise bar body 310 versions, meaning that in the given instance, that object is itself the type of means 342 employed. This use of the word has a generic sense to it. That is, the grasshopper leg spring 347 and spring seat 344 will always—at least potentially—be one kind of snap-fit means 342 but snap-fit means may be the grasshopper spring 347 and seat 344 in one case but something else such as a resilient integral finger 348 in another. However, the word comprise may also be used to describe a feature which is part of the structure or composition of a given object. Thus, the prior art release button 341 is indicated to have comprised as a component thereof, a protrusion molded upon it shaped to fit the button opening 343 of the bar's body 310. The meaning in the respective cases is clear from context, however. Accordingly, modifying words to clarify which of the three uses is the intended one seem unnecessary.

The word proximate with reference to two objects herein need not entail true nearness but may express a relative relationship between them. Thus, the release button 31 is said to be disposed proximate the receptor end 11 of the subject matter hereof while the button opening 33 is indicated to proximate the insertion end 12 thereof. The proximity in both cases is, nevertheless, such as to allow substantial clearance at those sites, however.

Terms relating to physical orientation such as top or bottom, upper or lower, refer to the positioning of the assembly in the manner it would be observed during a commonly practiced mode of operation. This convention has been adopted as a matter of convenience in discussing orientation and as shown in the drawings. Thus, the release button 31 is stated to be preferably disposed upon the bar body's uppermost surface 310 where it is most accessible to the operator; and that the cord stretching recess 49, when present, is described as being disposed longitudinally along the underside of the intervening section. The use of the terms in this manner must, of course, be interpreted so as to be equally understood regardless of what attitude the assembly is positioned—such as, for example, when it is inverted in switching from one mode of exercise to another. In such instances, it is appropriate to specifically qualify what is meant by such recitations as on top of or beneath.

The word longitudinal and derivations thereof refer merely to the longest dimension of a given object, provided it has one. Thus, it is stated herein that the cord stretching recess 49 along the intervening section's underside is longitudinal in disposition. This merely means that the recess 49 is oriented along the length of the structure.

In recent decades, popularity of exercise bar assemblies 300 has increased dramatically. The currently available models 300, while useful for many, could best be lengthened to suit the exercise needs of some who use them 300. Following that line, one might devise a short bar for youths, one of medium length for women and yet an elongated one for men. Better still would be an exercise bar capable of having its body itself 310 easily extended in length.

It readily occurs to one that an exercise bar's body 310 which can be taken apart for packing, storage or other convenience, might accept an intermediate piece to provide the desired length. Two part separable models, herein considered to be part of the prior art, have, in fact, already been provided by the applicant hereof.

Some of the prior art take-apart assemblies 300 additionally comprised a button opening 343 and snap-fit means of connection 342. Such means 342 usually comprised either a grasshopper leg spring 347 connected both to a separation release button 341 and a separation spring seat 344; or the more preferred plastic memory resilient integral finger 348. Upon depressing the button 341, it 341 was cleared from an otherwise obstructing site, permitting opposing portions of the exercise bar's elongated body 310 to separate from one another 310. Upon rejoining the portions 310 and releasing the button 341, causing it 341 to co-engage a button opening 343, the snap-fit connection means 342 returned the button 341 to its obstructing disposition thereby preventing unintended separation of the portions 310.

The bar separation seam 340 comprised the dividing place between the two parts of the bar's elongated extension or body 310. When the two pieces were interconnected, the release button 341 was disposed to emerge through the button opening 343—merely an orifice in the body of the longitudinal extension 310. The two pieces were usually shaped to slide together in telescope-like fashion as shown in FIGS. 16 and 17. The separated members of the exercise bar's body 310 may be considered to comprise a bar's receptor end 311 and a bar's insertion end 312. The bar body's receptor end 311 is that at which its button opening 313 is disposed. The body's insertion end 312 is that at which its separation release button 311 is disposed. These respective sites 311, 312 become important in connection with the subject matter hereof, ante.

The grasshopper leg spring 347—so named because of its strength and resilience when bent and seated as shown there—together with a spring seat within the bar's body 310 sometimes comprised the snap-fit means 342 provided in certain of the prior art exercise bar body 310 versions. It 347 was connected to the release button 341 in any known manner; often by impingement within a hollow disposed within the button 341. The mid-portion of the spring 347 could be bent to accomplish this fitted connection. The ends of the spring 347 were then preferably bent as shown and fitted along portions within the body 310 to provide a firm tensioning seat. When the button 341 was depressed, it 341 cleared the opening 343 and the two body 310 pieces could be pulled apart at the separation seam 340. When the pieces were slid back together, by reason of the tension provided by the grasshopper leg spring 347, the button 341 popped through the opening 343 the instant the two 341, 343 became aligned.

The resilient integral finger 348 comprised merely a somewhat elongated partial cut-out in the bar's body 310, permitting it 348 to be pushed downward so that its 348 inherent plastic memory provided it 348 a springboard-like character. Thus, when released, it 348 popped back into its 348 previous position. The release button 341 comprised a protrusion molded upon it shaped to fit the button opening 343 so that the mechanism produced the same result as that of the grasshopper leg spring 347. The cut-out, had the shape of three sides of a rounded rectangle. One of the finger's 348 short sides—uncut—of course, remained attached to the body 310 from which it 348 was formed. This version of snap-fit means 342 was understandably preferred in large part because of its 348 lower production cost.

One may conceive of various other snap-fit means 342, of course. Over the years, a number of longitudinal pole or pipe extension schemes have emerged which would provide an acceptable connection. Although great effort is not required to snap-fit the body's 310 pieces together or pull them apart once the release button 341 is depressed, because of the body's 310 structural integrity, the connection could properly have been considered one of rigid emplacement.

Certain modes of exercise were also made possible in the prior art exercise bar assembly 30 by the usual addition of an underlying cord stretching recess 371 in the bar's body 310, a feature which permitted the stretchable exercise cord 200 to seat within it 371 against the bar's body 310 with the ends of the cord 200 anchored elsewhere.

U.S. Pat. No. 1,456,304 issued to Fritschka represented in part a fairly early version of prior art snap-fit means 342 in which a spring supported button 341 was urged through a button opening 343 to lock together two parts of a combination walking stick and outdoor stool. U.S. Pat. No. 2,937,653 issued to Danciart, et al provided similar means 342 for the take-apart center-post of the familiar beach umbrella. These useful constructions did not immediately translate over into any of the exercise bar assemblies 300. U.S. Pat. No. 4,316,610 issued to Hinds, the inventor herein, provided an exercise bar assembly 300 featuring snap-fit means 342 entirely within the bar's body 310, so that there was no exterior projecting button 341 to depress. The two portions of the bar's body 310 were merely pushed together or pulled apart to forcibly compress or expand the supporting spring. Because the put-together and take-apart works was ensconced entirely inside the bar's body 310, repair or replacement of a failed spring would provide difficulty. Looking beyond the differences between the snap-fit means 342 therein from that 342 provided by the subject matter hereof, however, that patent may be properly recognized as prophetic in expressing the possibility of incorporating within the length of the bar's body 310 one or more sections to be added to the two already present.

As merit-worthy as the exercise bar assemblies 300 of prior art were, such additional section accommodation would be highly beneficial where increased bar body 310 length is sought after. The more recent prior art assemblies 300 offer considerable benefit to exercise enthusiasts in meeting the needs and objectives relevant. Some still remain to be addressed, however.

SUMMARY OF THE INVENTION

In its most important aspect, the invention is a construction which may be emplaced for connection within the mid-portion of a separable exercise bar's body 310. Emplacement is effected at the bar's separation seam 340 by disconnecting respective parts of the body 310 and snap-fitting the structure into it, thereby increasing the bar's overall length. The separation and rejoining means already in place within the body 310 is duplicated and used within this intermediate structure. Thus, duplications of the exercise bar's separation release button 341 and button opening 343 are made to appear at opposing ends of the intervening section. Thus, the section's insertion end 12 may be slid into the bar's body 310 and the bar's separation release button 341 caused to pop in snap-fit fashion into the section's button opening 33; and the bar body 310 may be slid into the section's receptor opening 11 and the section's separation release button 31 caused to similarly connect with the bar body's 310 button opening 343.

The button 341 is connected to known prior art snap-fit structures preferably comprising either a grasshopper leg spring 47 and spring seat 44 or a resilient integral finger 48 molded within the structure itself.

By thus snap-fitting the intermediate section into place, the exercise bar's body 310 is effectually lengthened.

An orientation assuring track 45 and orientation juncture groove 46 are also present to aid in the section's emplacement and retention.

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

DESCRIPTION OF THE PREFERRED EMBODIMENT

Figure 1:
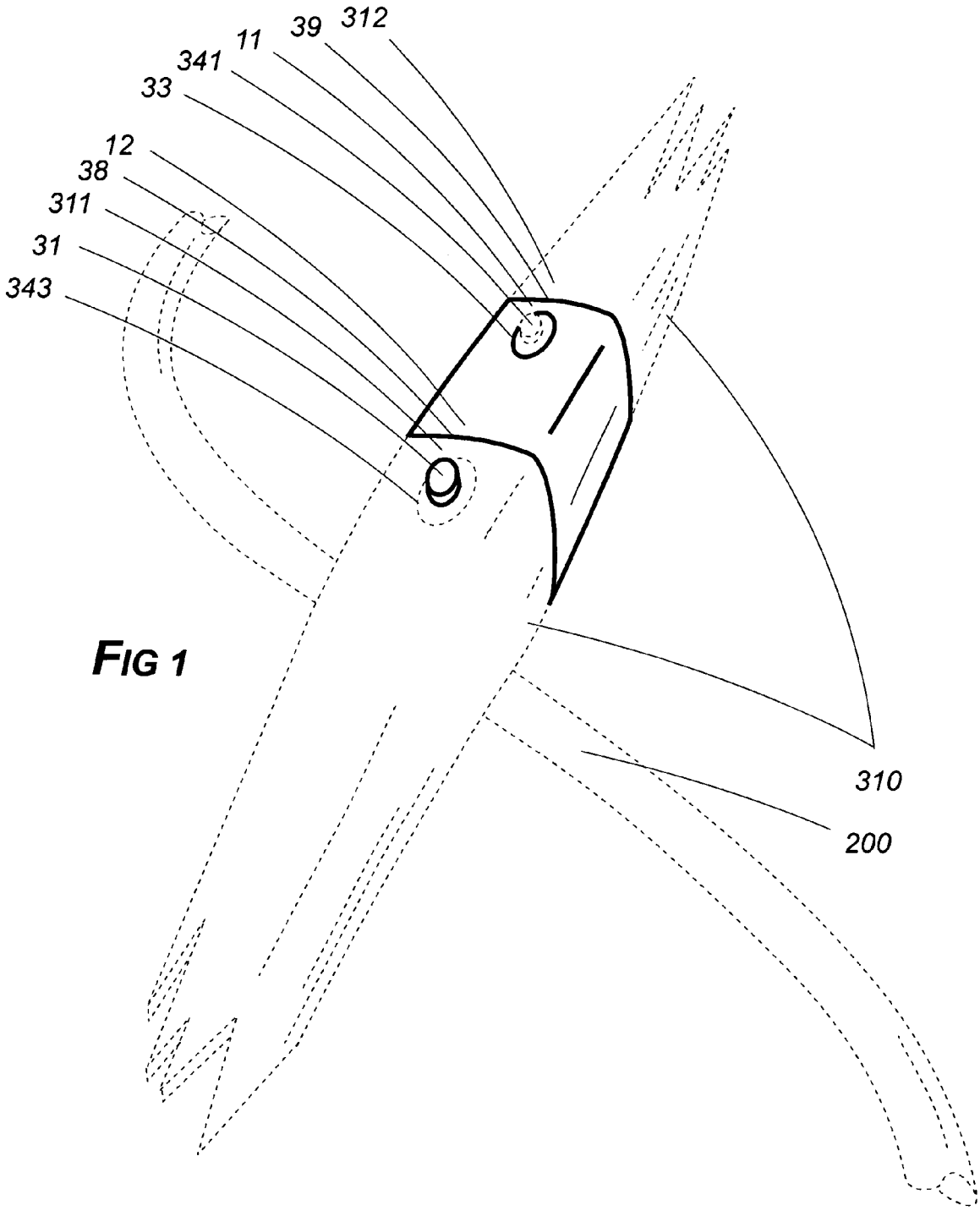
FIG. 1 represents a cut-away view of an exercise bar assembly 300 wherein the intervening section therefor is connected by snap-fit means at each of its ends to the bar's elongated body 310.
Figure 2:
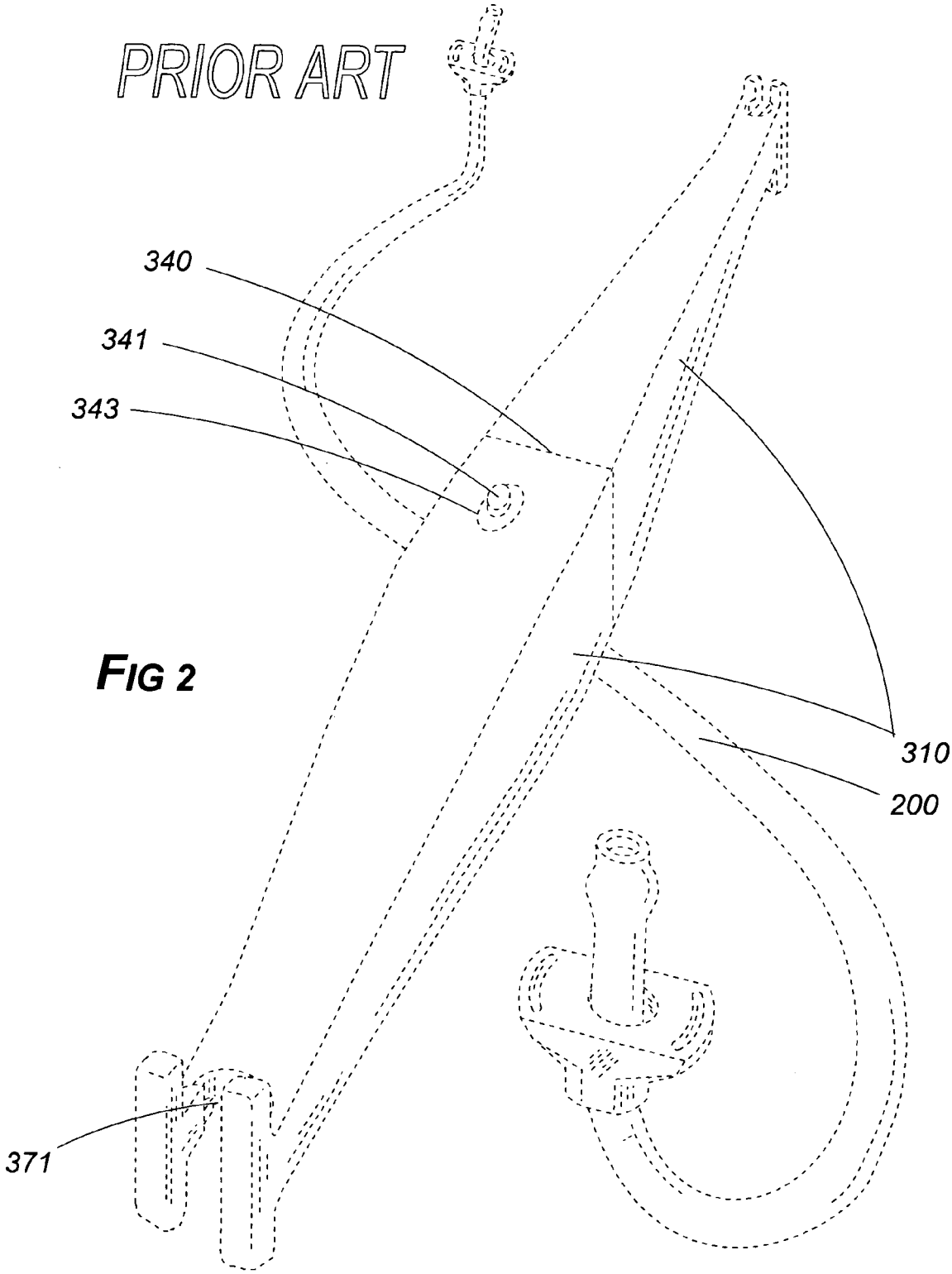
FIGS. 2-12 are perspective depictions of exercise bar assemblies 300 capable of accommodating the subject matter of this application as respective improvements thereto. All were previously invented by the applicant hereof and most are the subject matter of pending applications. The assembly disclosed by FIG. 9 comprises that of an expired patent. Although certain portions of all are carried over in one case or another as a novel part of the combination which is the subject hereof, for the sake of discussion the entirety or wholeness of each of those assemblies is herein designated prior art.
Figure 3:
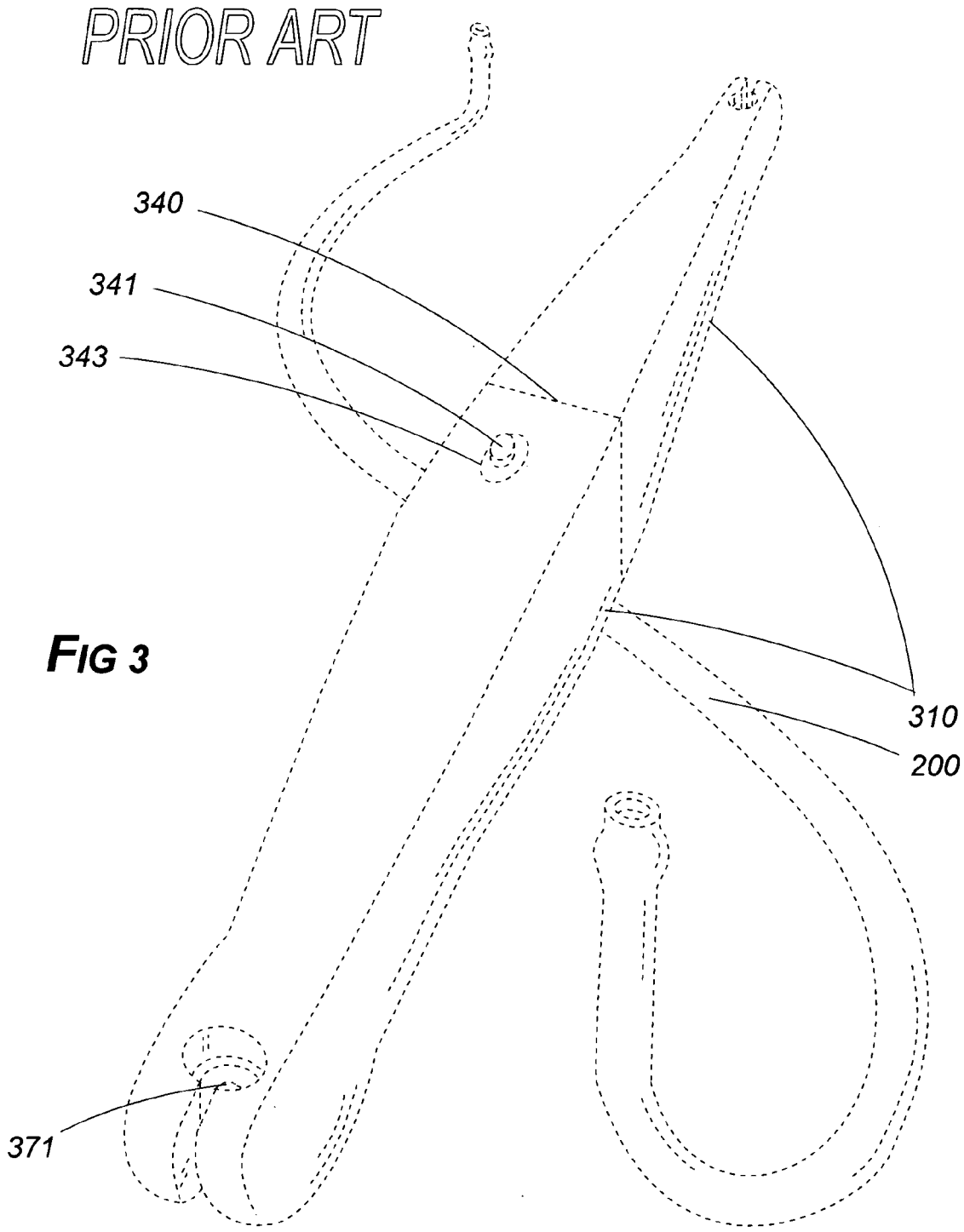
Figure 4:
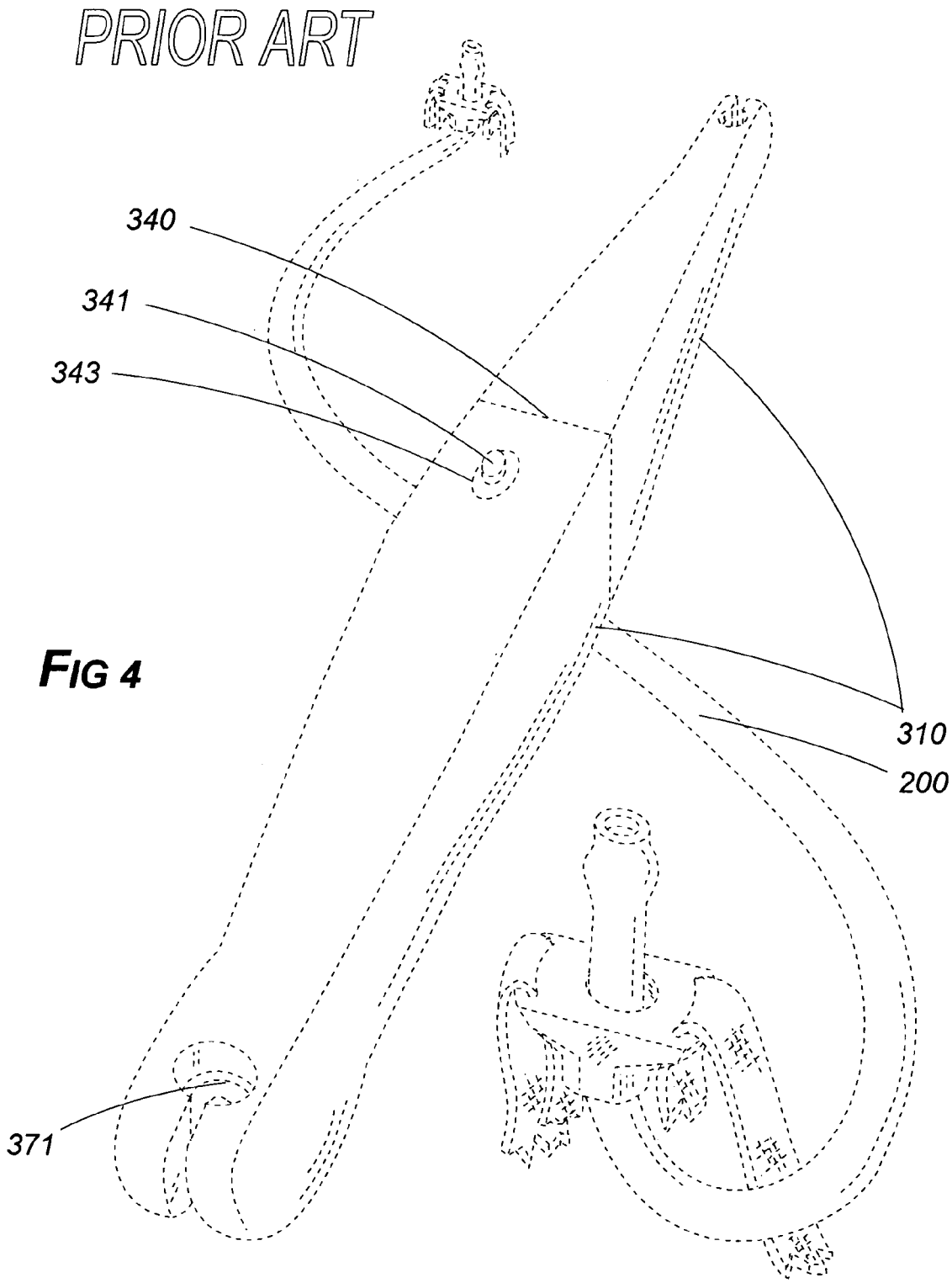
Figure 5:
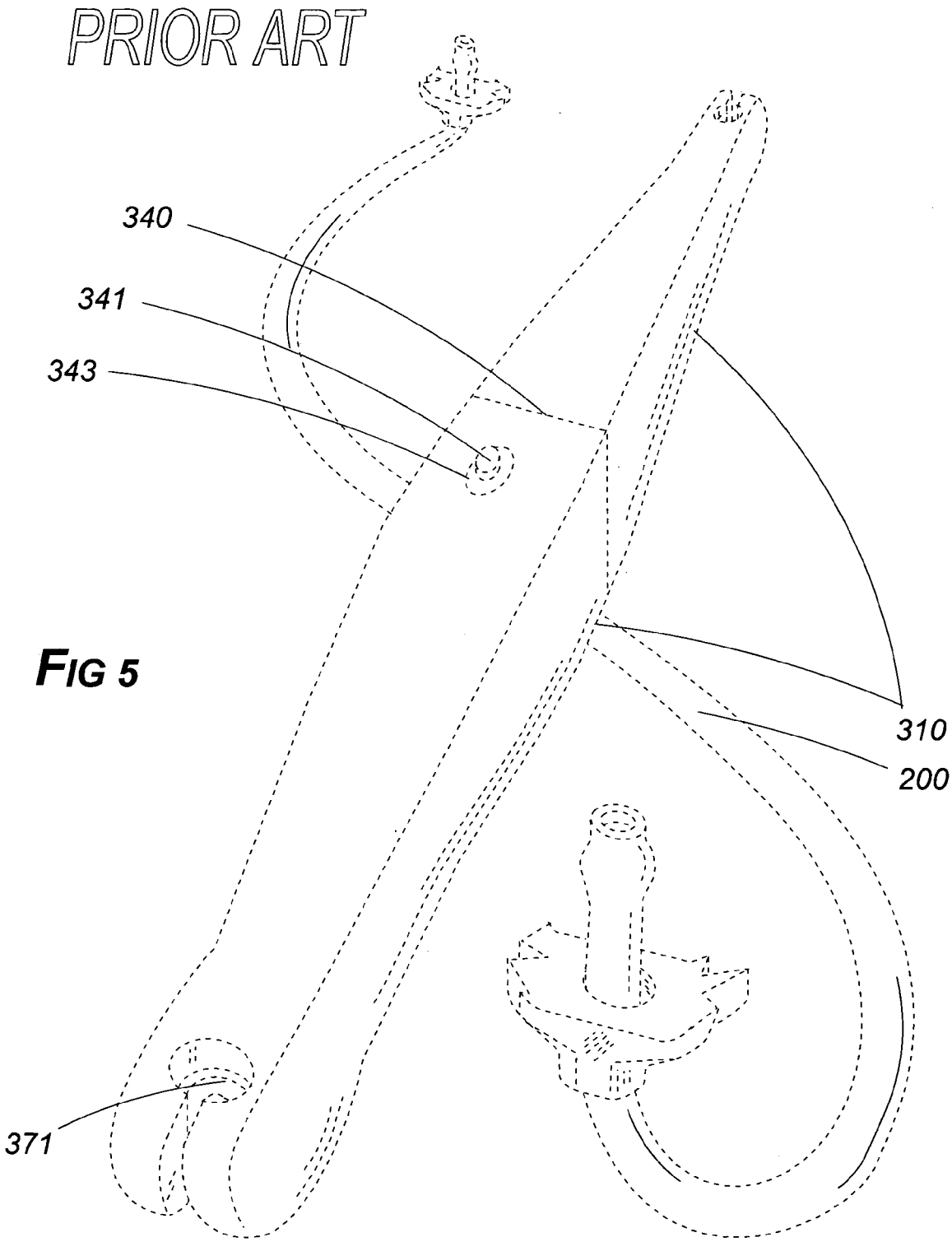
Figure 6:
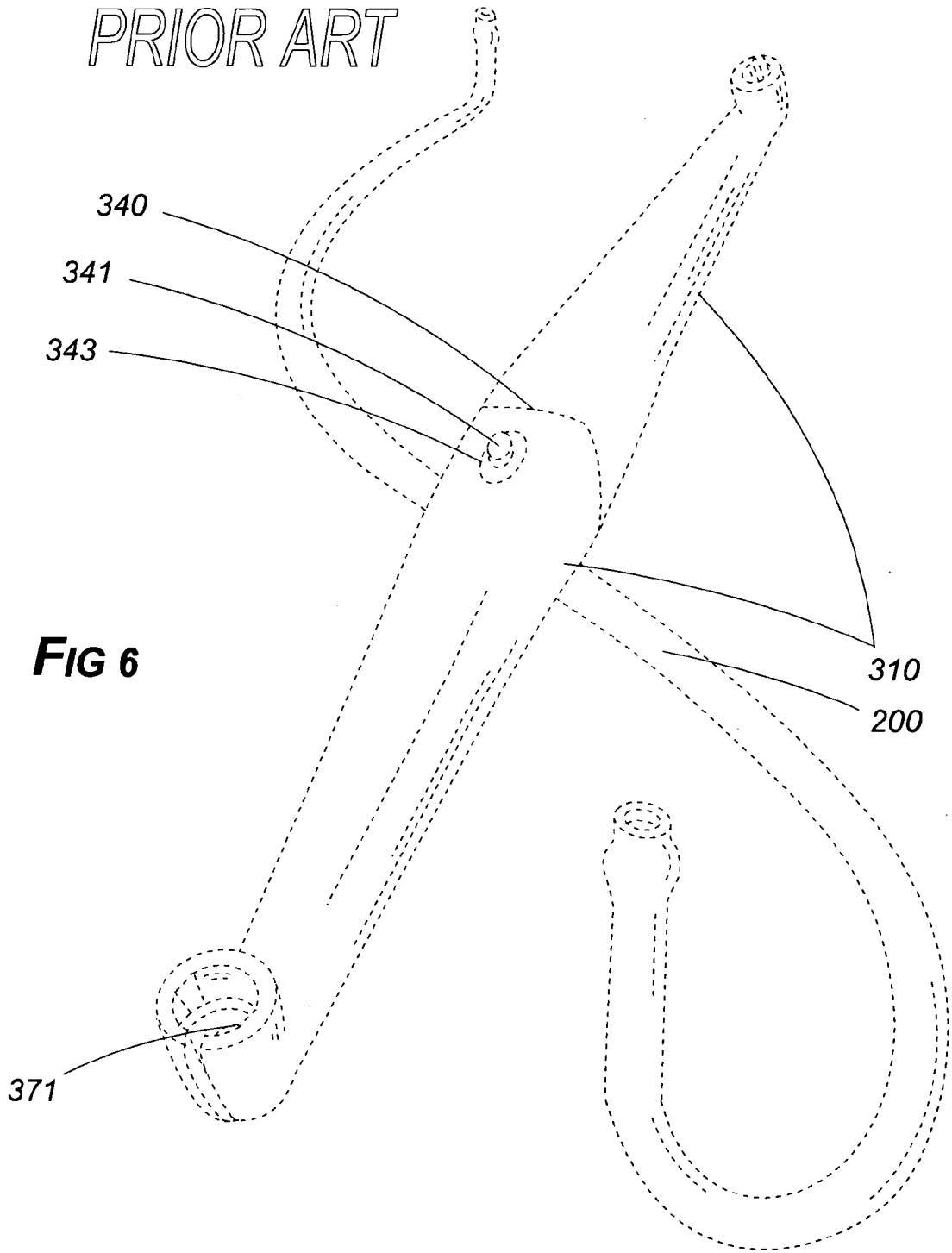
Figure 7:
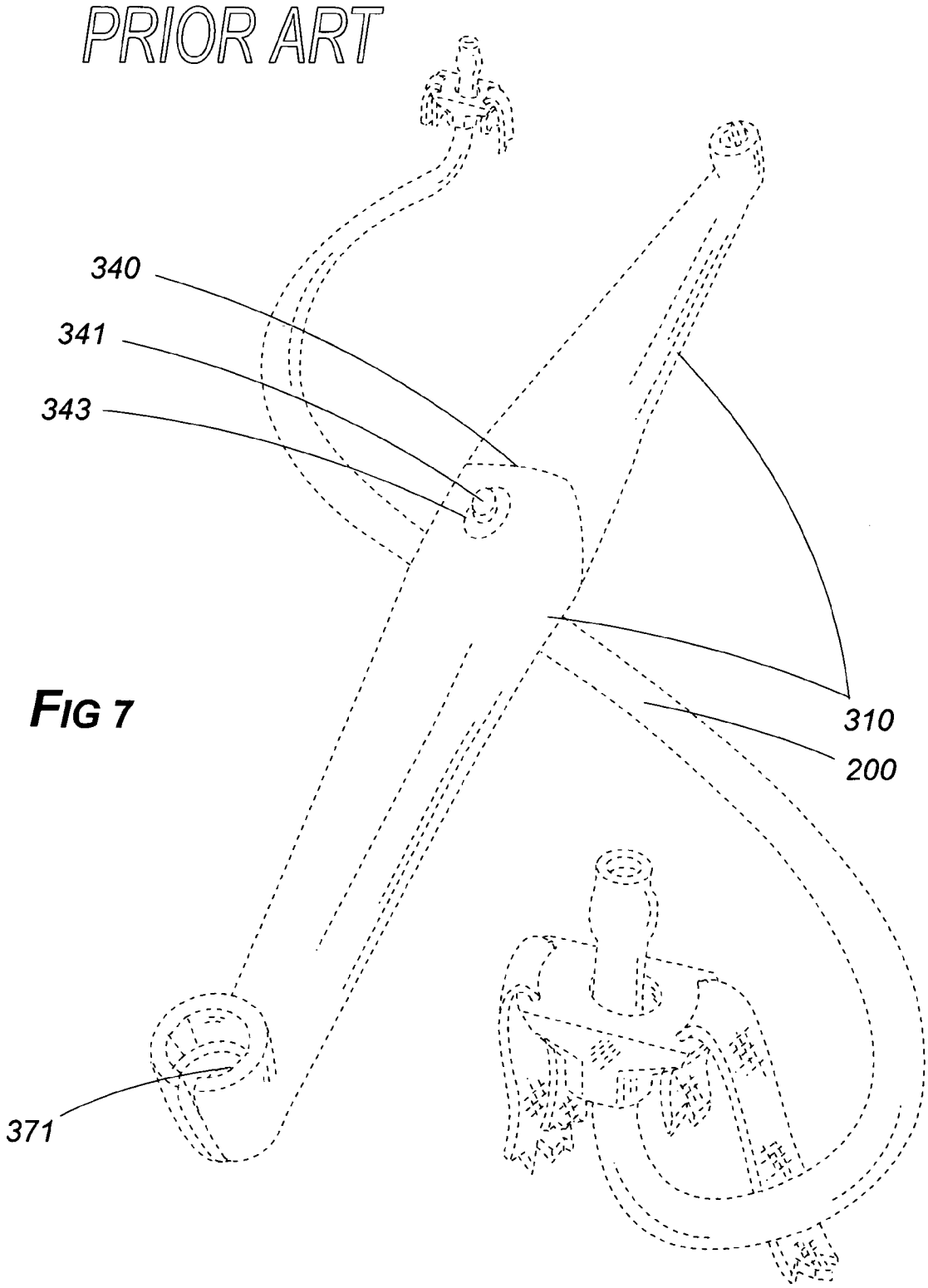
Figure 8:
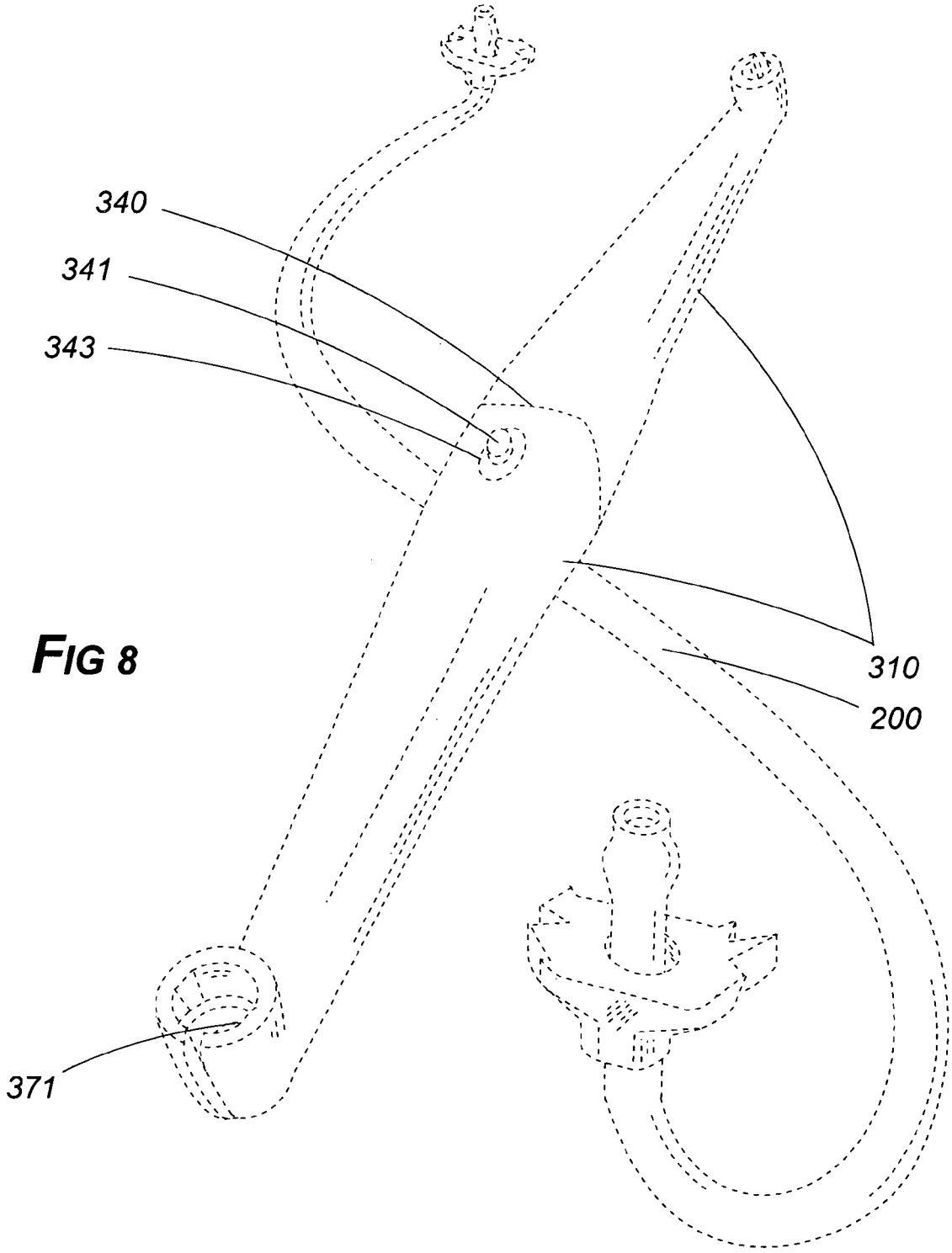
Figure 9:
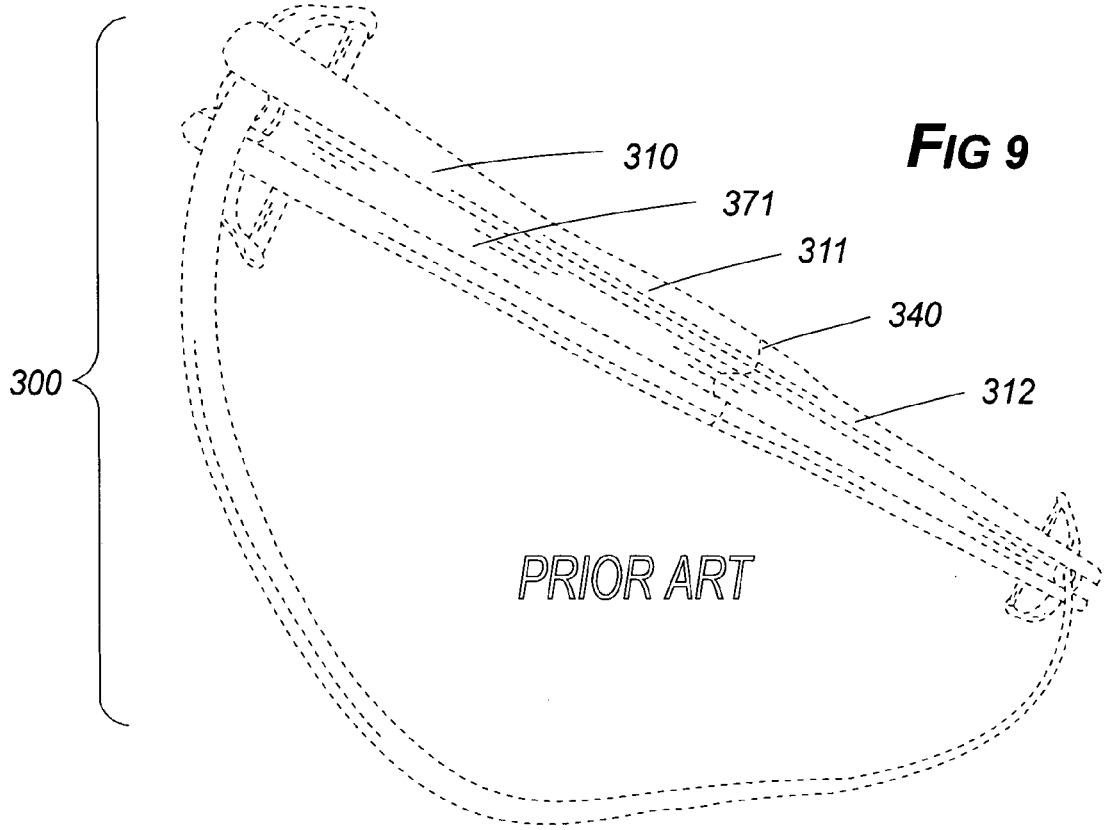
Figure 10:
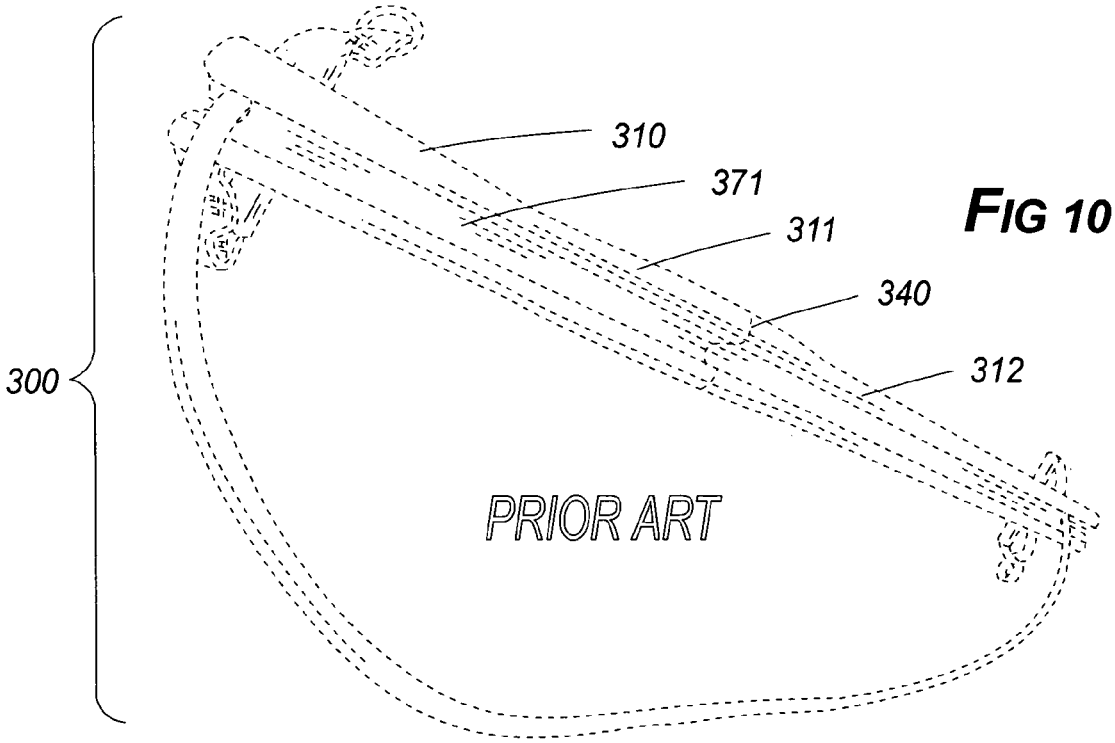
Figure 11:
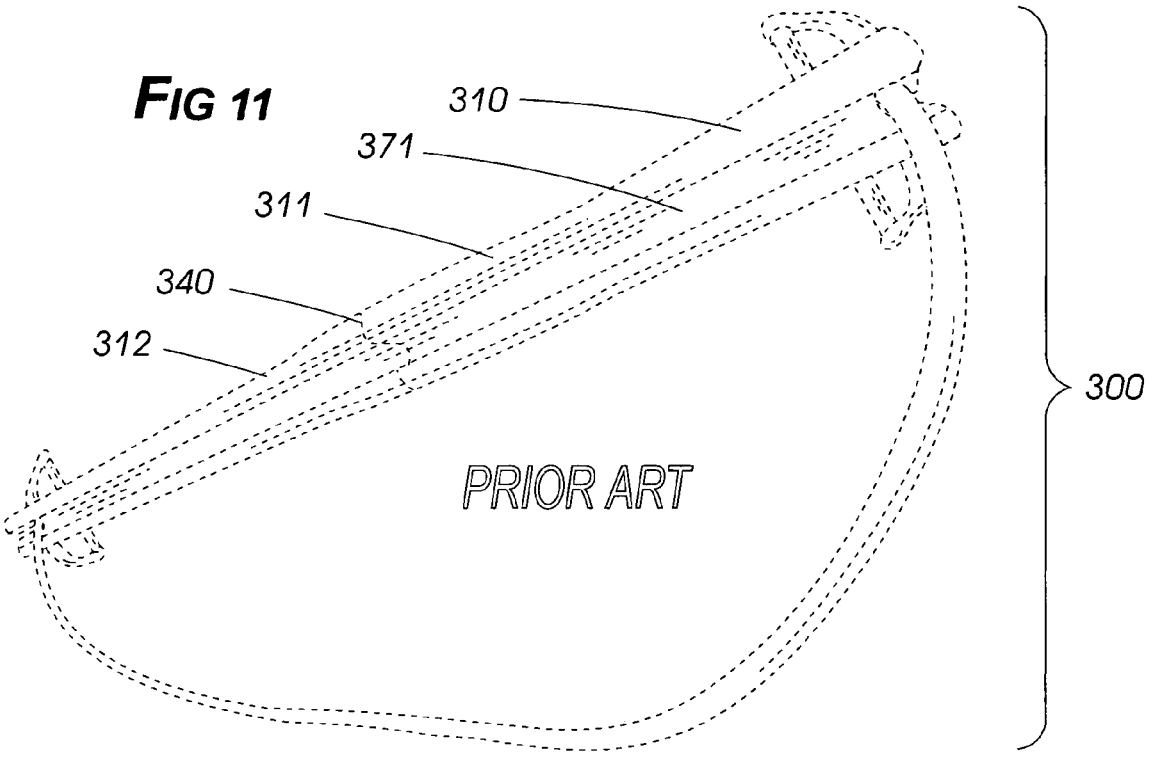
Figure 12:
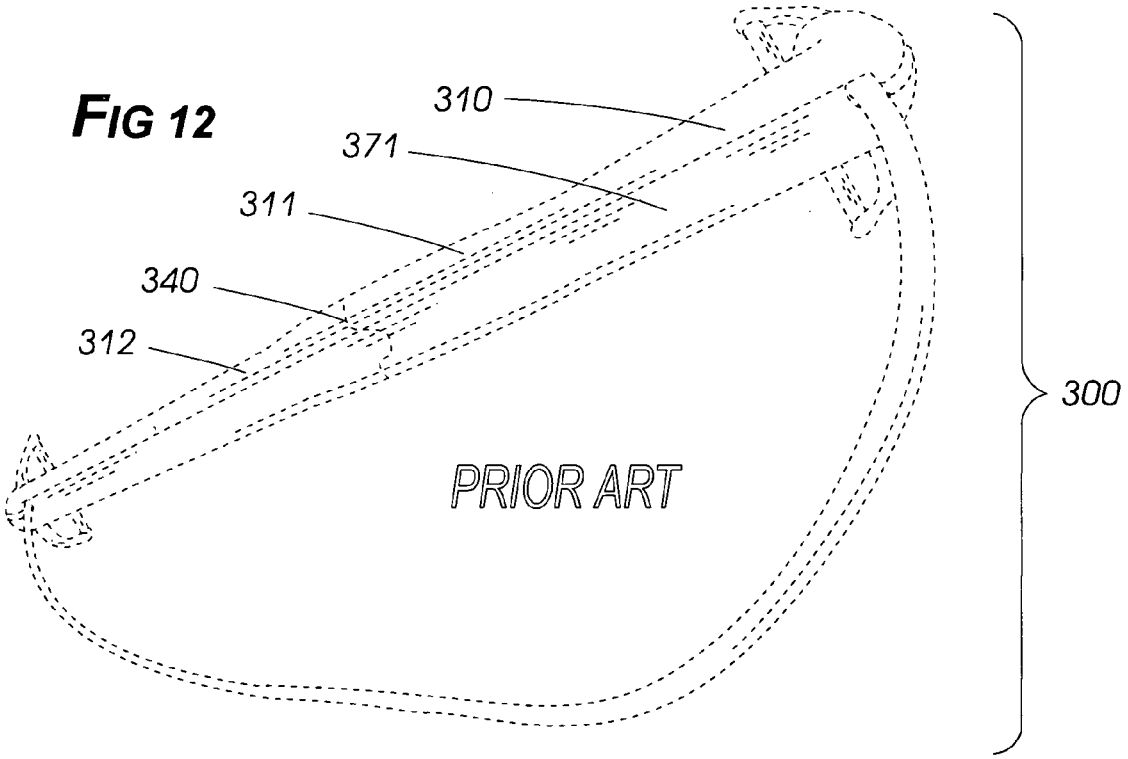
Figure 13:
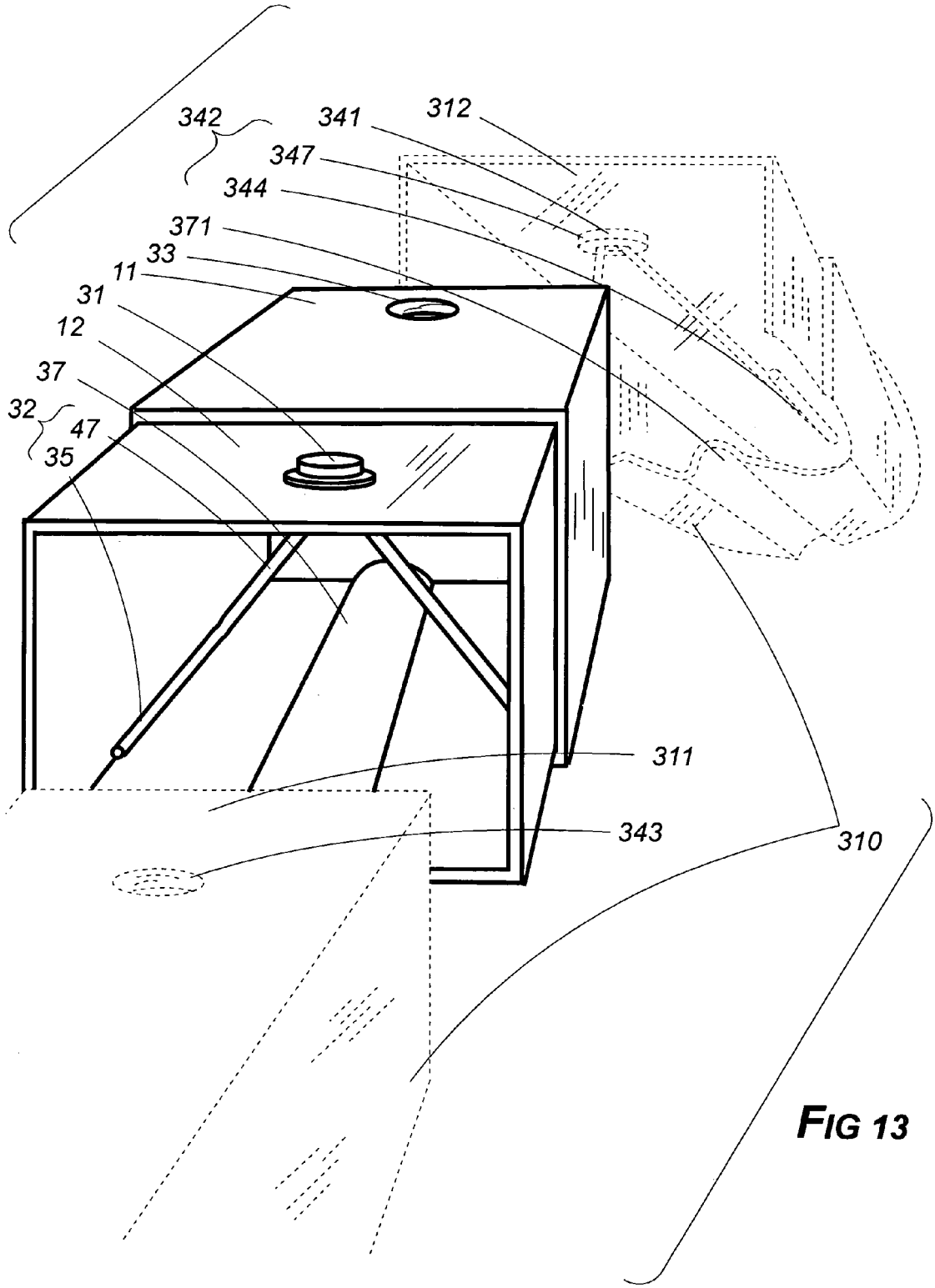
FIGS. 13 and 14 illustrate embodiments of the invention positioned for connection by separation snap-fit means 32 to the elongated body 10 portions of respective exercise bars. The means 32 is shown in FIG. 13 to comprise a grasshopper leg spring 347 and in FIG. 14, a resilient integral finger 34.
Figure 14:
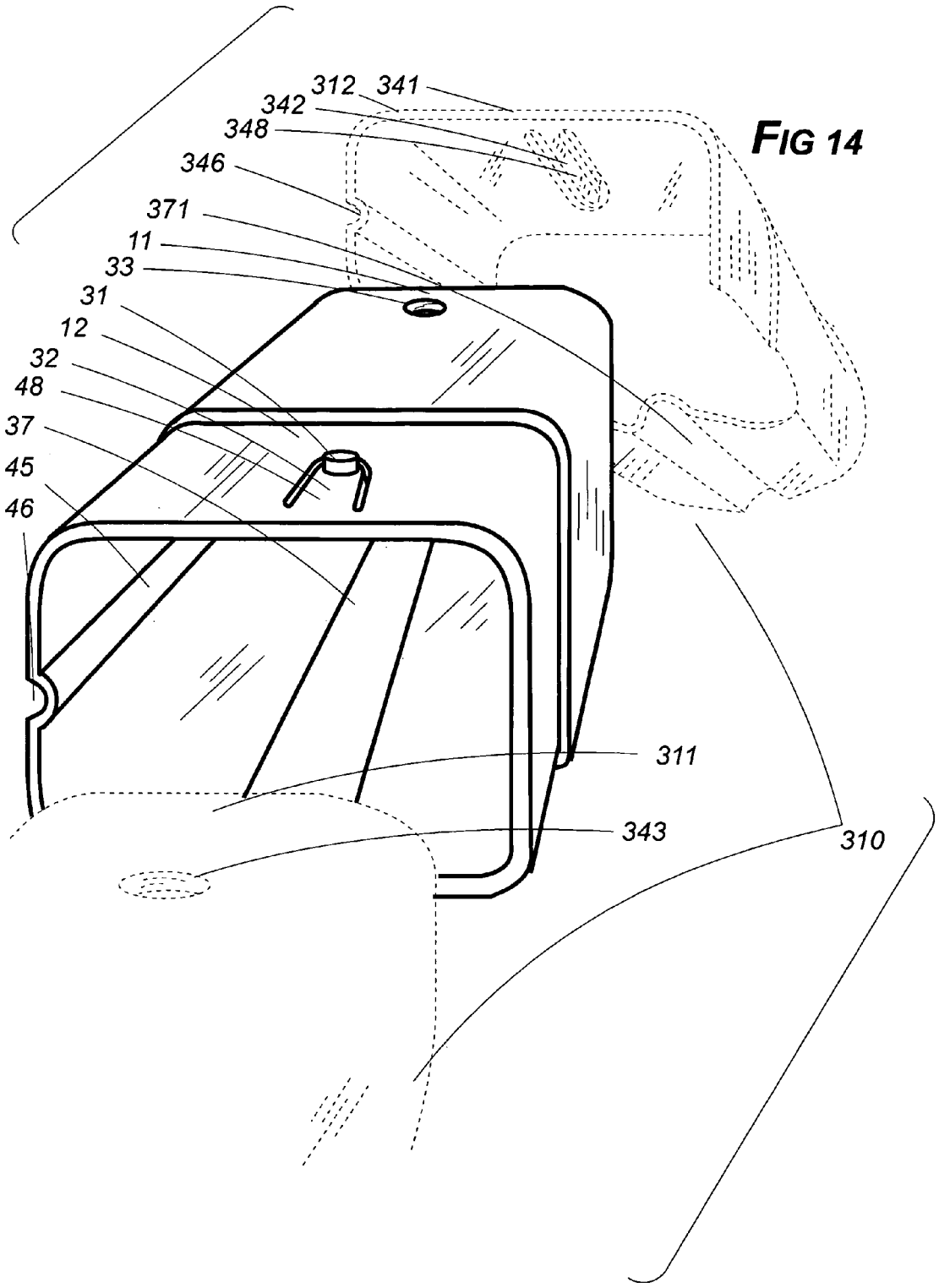
Figure 15:
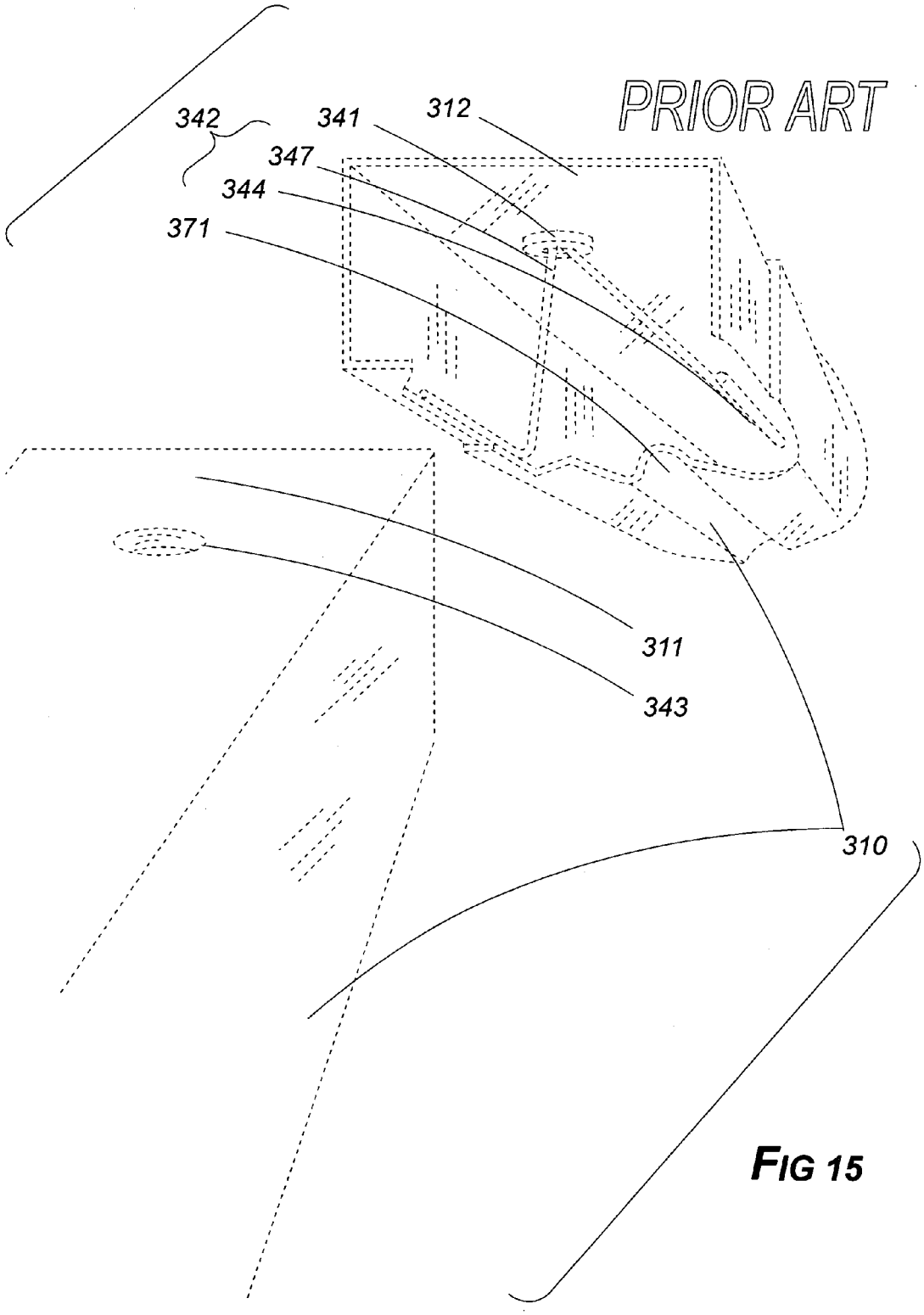
FIGS. 15 and 16 address prior art versions of embodiments in which snap-fit means 32 were employed to join opposing parts of the exercise bar's elongated body 10.
Figure 16:
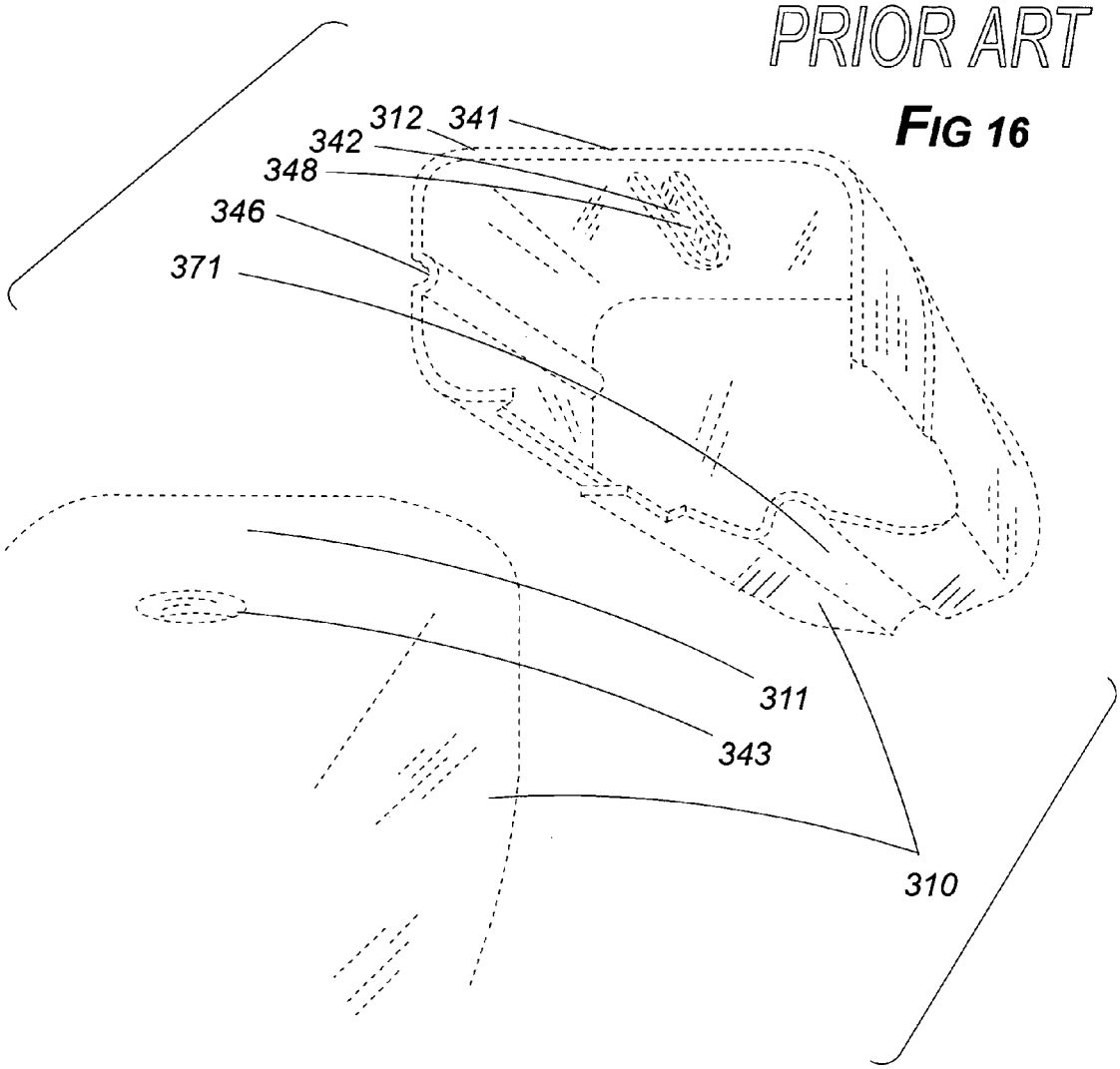
Figure 17:
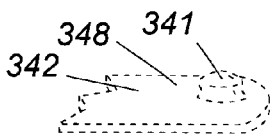
FIG 17 PRIOR ART
FIG. 17 features a resilient integral finger 34 as prior art snap-fit means 32.
Figure 18:
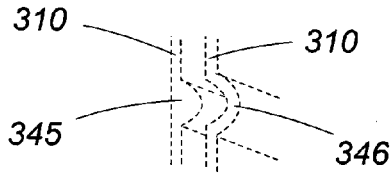
FIG 18 PRIOR ART
FIG. 18 comprises an orientation securing track 345 and orientation juncture groove 346 as convenient prior art means of aligning the pieces of the exercise bar's elongated body 10 when snap-fitted 32 together.

The subject of this application is an intervening section for an exercise bar body 310, the section is in the main comprised of a separation release button 34, a button opening 33 and separation snap-fit means 32. This combination permits the section to be snap-fitted into the mid-portion of a prior art exercise bar body 310, itself 310 already comprising snap-fit means 342 of its 310 own by which it 310 was already capable of being separated for storage, portability or other convenient handling. By reason of its emplacement, the snapped-in section effectually lengthens the bar's body 310.

The intervening section is configured slightly elongated, thereby comprising an insertion end 11 and a receptor end 12. Its interior is preferably configured to match the interior of the particular exercise bar body 310 it is designed to be joined to. Thus, if the bar's body 310 has a hollow aspect, the intervening section is also preferably hollowed. It should be recognized, of course, that an exercise bar body 310—and for that matter, the subject matter hereof—may be generally of solid configuration comprising merely a hollowed sector allowing space to accommodate the snap-fit means referred to supra. Completely hollow construction, however, is less expensive to manufacture, provides the more sought-after lightweight characteristic and is generally simpler to produce in the molding process.

The intervening section's release button 31 is disposed proximate the section's insertion end 11 and the section's button opening 33 proximate its receptor end 12. Each 31, 33 should be set back sufficiently to assure some degree of security upon the joining of the respective parts.

The intervening section's separation release button 31 is disposed to work in conjunction with the button opening 343 of the bar's body 310, disposed upon the section—preferably upon its uppermost surface where it is readily accessible to the operator—and configured to operate in the same manner as the bar body's release button 341, so that when the intermediate section's insertion end 11 is joined to the body's separation receptor end 311, the section's release button 31 will snap through the body's button opening 343 in the same manner the body's release button 341 would have if the intervening section were not in place.

Conversely, an intermediate section's button opening 33 is disposed to work in conjunction with the separation release button 341 of the bar's body 310. The button opening 33 is disposed upon the intervening section and configured to operate in the same manner as the bar body's button opening 343, so that when the section's receptor end 12 is joined to the bar body's insertion end 312, the body's release button 341 will snap through the intervening section's button opening 33 in the same manner it 341 would have with the body's button opening 343 if the intervening section were not in place.

Preferably, the fit between the intervening section's ends 11, 12 and that of the bar body's separation ends 311, 312 are both snug and the respective members joined are, therefore, properly stated to be mated in configuration and size to the cross-sectional configuration and size of the exercise bar's body 310. Moreover, the relationship of any separation release button 31, 341 to its respective button opening 33, 343 is such that upon proper alignment, the button 31, 341 is urged through a respective button opening 33, 343 by snap-fit means, thereby retaining the joined members.

Just as the separation seam 340 comprised merely the dividing place between the two parts of the prior art bar's elongated body 310, snap-fitting the intermediate section in place transforms that singular seam 340 into two sectional separation seams 38, 39—one at each of the section's ends 11, 12, respectively. That nearest the insertion end 11 is herein designated the section's insertion separation seam 38; that nearest its receptor end 12, its receptor separation seam 39.

As was the case with the prior art exercise bar's snap-fit means of connection 342, that 32 of the intervening section preferably comprises a release button 31 and either a grasshopper leg spring 47 connected both to it 31 and a separation spring seat 44; or the more preferred resilient integral finger 48. Upon depressing the button 31, it 31 is cleared from an otherwise obstructing site, permitting the intervening section at its receptor end 11 to separate from the exercise bar's elongated body 310. A similar effort is required—depression of the exercise bar's button 341 to clear it 341 from the otherwise obstructing site comprising the intervening section's button opening 33—to permit separation of the intervening section at its insertion end 12 from the bar's body 310. Upon sliding the pieces back together the portions—31, 310 and 33, 310—become rejoined. This is accomplished by two simple operations, identical but at different sites. The section's depressed button 31 is released, causing it 31 to co-engage or pop through the bar body's opening 343 the instant the two 31, 343 become aligned. This snap-fit connection means 32 returns the button 31 to its obstructing disposition thereby preventing unintended separation of the intervening section's receptor end 11 from the bar's body 310. Similarly, releasing the bar body's depressed button 341 and causing it 341 to co-engage the intervening section's button opening 33, by reason of the tension provided by either the grasshopper leg spring 47 or the resilient integral finger 48 reconnects the section's insertion end 12 to the body 310.

The grasshopper leg spring 47 and separation spring seat 44 when employed herein, comprise the same configuration, function and relative disposition as their counterparts 347 within any of the prior art exercise bar assemblies 300. Similarly, the resilient integral finger 48, when employed herein, comprises the same configuration, function and relative disposition as their counterparts 348 for those models. It should be readily apparent, of course, the same is true of the section's separation release button 31 and button openings 33 vis-a-vis their counterparts 341, 343, respectively, in the prior art constructions.

As in prior art, the grasshopper leg spring 47—so named because of its strength and resilience when bent and seated as shown there—is connected to the release button 31 in any known manner; preferably by impingement within a hollow disposed within the button 31. The mid-portion of the spring 47 may be bent to accomplish this fitted connection. The ends of the spring 47 are then preferably bent as shown and fitted along portions within the body 310 to provide firm tension at the separation seat 44 within the section, supra.

The resilient integral finger 48, similarly as in prior art, comprises merely a somewhat elongated partial cut-out in the intervening section, permitting it 48 to be pushed downward so that its 48 inherent plastic memory provides it 48 a springboard-like character. Thus, when released, it 48 pops back into its previous position. The release button 31 comprises a protrusion molded upon it shaped to fit the bar body's button opening 343 so that the mechanism produces the same result as that of the grasshopper leg spring 47. The cut-out, has the shape of three sides of a rounded rectangle. One of its 48 short sides—uncut—of course, remains attached to the intervening section from which it 48 is formed. This version of snap-fit means 32 is preferred in large part because of its 48 lower production costs.

One may conceive of various other snap-fit means 32, of course. Although great effort is not required to snap-fit the pieces together or pull them apart once the release buttons 31, 341 are depressed, because of the structural integrity of the bar body 310 and the intervening section which is the subject hereof, the connection may properly be considered one of rigid emplacement as it has been at prior art.

If the exercise bar body 310 comprises a cord stretching recess 371, a similarly configured sectional cord stretching recess 49 is disposed longitudinally upon the intermediate section's underside so that the surfaces match when the section is snap-fitted into place. This is consistent with the preference herein that the intervening section's configuration be consistent with that of the exercise bar's body 310.

An orientation assuring track 45 and orientation juncture groove 46 are also present to aid in the section's emplacement and retention.

The inventor hereby claims:

1. An intervening section for an exercise bar comprising
an insertion end;
a receptor end;
a separation release button proximate the insertion end;
a button opening proximate the receptor end; and
separation snap-fit means;

wherein the section's insertion and receptor ends are mated in configuration and size to the cross-sectional configuration and size of an exercise bar's elongated body whereby the section's insertion end fits snugly within and is snap-fitted to an exercise bar's separable receptor end and the exercise bar's separable insertion end fits snugly within and is snap-fitted to the section's receptor end; each respective separation release button disposed, upon connecting the intervening section to the exercise bar's body, into alignment with a respective button opening through which it is urged by snap-fit means, thereby retaining the joined members such that the intervening section increases the effectual length of the bar's elongated body.

2. The intervening section for an exercise bar according to claim 1 wherein the separation snap-fit means comprised by the insertion end comprises a grasshopper leg spring.

3. The intervening section for an exercise bar according to claim 1 wherein the separation snap-fit means comprised by the receptor end comprises a resilient integral finger.

4. The intervening section for an exercise bar according to claim 1 further comprising an orientation assuring track and an orientation juncture groove.

5. The intervening section for an exercise bar according to claim 1 wherein the bar's elongated body further comprises a cord stretching recess, thereby permitting certain modes of exercise.

* * * * *